US009867427B2

(12) United States Patent
Fujita et al.

(10) Patent No.: US 9,867,427 B2
(45) Date of Patent: Jan. 16, 2018

(54) SHOE SOLE

(71) Applicant: Asics Corporation, Kobe-Shi (JP)

(72) Inventors: Yoshinori Fujita, Kobe (JP); Syuhei Takemura, Kobe (JP); Seiya Hayashi, Kobe (JP)

(73) Assignee: ASICS Corporation, Kobe-shi (JP)

( * ) Notice: Subject to any disclaimer, the term of this patent is extended or adjusted under 35 U.S.C. 154(b) by 30 days.

(21) Appl. No.: 15/027,679

(22) PCT Filed: Oct. 10, 2013

(86) PCT No.: PCT/JP2013/077631
§ 371 (c)(1),
(2) Date: Apr. 6, 2016

(87) PCT Pub. No.: WO2015/052814
PCT Pub. Date: Apr. 16, 2015

(65) Prior Publication Data
US 2016/0255911 A1 Sep. 8, 2016

(51) Int. Cl.
*A43B 13/12* (2006.01)
*A43B 13/22* (2006.01)
(Continued)

(52) U.S. Cl.
CPC ..... *A43B 13/223* (2013.01); *A43B 5/02* (2013.01); *A43B 5/06* (2013.01); *A43B 13/04* (2013.01);
(Continued)

(58) Field of Classification Search
CPC ..... A43B 5/02; A43B 13/04; A43B 13/12; A43B 13/26; A43C 13/04; A43C 15/00; A43C 15/16; A43C 15/168
(Continued)

(56) References Cited

U.S. PATENT DOCUMENTS 4,130,947 A * 12/1978 Denu ..... A43B 13/12 36/30 R
4,481,727 A * 11/1984 Stubblefield ..... A43B 5/00 36/30 R
(Continued)

FOREIGN PATENT DOCUMENTS

EP 0 990 397 A1 4/2000
JP S5690105 7/1981
(Continued)

OTHER PUBLICATIONS

Extended European Search Report for European Patent Application No. 13 89 5346 dated May 26, 2017.
(Continued)

*Primary Examiner* — Marie Bays
(74) *Attorney, Agent, or Firm* — Katten Muchin Rosenman LLP

(57) ABSTRACT

An outsole includes: a plate-like base; a plurality of first cleats protruding in the downward direction from the base to form the tread surface, wherein the plurality of first cleats are arranged in the longitudinal direction and in the transverse direction; and a concave surface recessed in the downward direction on the upper surface of each of the first cleats, wherein: the lower surface of the midsole includes a convex surface formed by a surface of a convex portion protruding in the downward direction from a base of the midsole; the concave surface and the convex surface are in contact with, and attached to, each other; and a distance from the tread surface in each of the first cleats to a top of the convex surface is greater than a thickness of the base.

13 Claims, 5 Drawing Sheets

(51) Int. Cl.

| | |
|---|---|
| ***A43B 5/02*** | (2006.01) |
| ***A43C 15/16*** | (2006.01) |
| ***A43B 13/18*** | (2006.01) |
| ***A43B 13/26*** | (2006.01) |
| ***A43B 5/06*** | (2006.01) |
| ***A43B 13/04*** | (2006.01) |
| ***A43B 13/14*** | (2006.01) |

(52) U.S. Cl.
CPC ..... *A43B 13/12* (2013.01); *A43B 13/125* (2013.01); *A43B 13/141* (2013.01); *A43B 13/181* (2013.01); *A43B 13/187* (2013.01); *A43B 13/26* (2013.01); *A43C 15/16* (2013.01); *A43C 15/168* (2013.01)

(58) Field of Classification Search
USPC ..... 36/30 R, 32 R, 67 R, 114, 134
See application file for complete search history.

(56) References Cited

U.S. PATENT DOCUMENTS 5,077,916 A * 1/1992 Beneteau ..... A43B 5/001 36/128
5,155,927 A 10/1992 Bates et al.
5,367,791 A * 11/1994 Gross ..... A43B 13/26 36/25 R
5,493,792 A 2/1996 Bates et al.
5,718,063 A 2/1998 Yamashita et al.
6,199,302 B1 3/2001 Kayano
6,212,795 B1 4/2001 Nakabe et al.
6,438,870 B2 8/2002 Nasako et al.
6,467,197 B1 10/2002 Mitsui et al.
6,516,539 B2 2/2003 Nishiwaki et al.
6,647,646 B2 11/2003 Mitsui et al.
D495,859 S 9/2004 Kubo et al.
D495,860 S 9/2004 Kubo et al.
D496,148 S 9/2004 Kayano et al.
D501,713 S 2/2005 Kayano et al.
D501,987 S 2/2005 Kubo et al.
D509,351 S 9/2005 Kayano et al.
D512,208 S 12/2005 Kubo et al.
D512,818 S 12/2005 Mitani et al.
D512,819 S 12/2005 Usuki et al.
D512,827 S 12/2005 Usuki et al.
D512,828 S 12/2005 Kubo et al.
D513,115 S 12/2005 Kayano et al.
D514,286 S 2/2006 Kayano et al.
D520,732 S 5/2006 Mitani et al.
D522,229 S 6/2006 Kubo et al.
D542,522 S 5/2007 Fujita et al.
D552,833 S 10/2007 Yamashita et al.
D553,846 S 10/2007 Kayano et al.
7,322,131 B2 1/2008 Yamashita et al.
D561,434 S 2/2008 Fujita et al.
D561,442 S 2/2008 Kayano et al.
7,325,323 B2 2/2008 Katsu et al.
D571,086 S 6/2008 Yamashita et al.
D571,090 S 6/2008 Fujita et al.
D575,486 S 8/2008 Yamashita et al.
D575,946 S 9/2008 Mitani et al.
D582,658 S 12/2008 Fujita et al.
7,523,566 B2 * 4/2009 Young-Chul ..... A43B 13/12 36/28
7,779,558 B2 8/2010 Nishiwaki et al.
7,877,899 B2 2/2011 Nishiwaki et al.
7,987,618 B2 8/2011 Nishiwaki et al.
8,008,363 B2 8/2011 Mori et al.
D650,566 S 12/2011 Yamashita et al.
8,074,377 B2 12/2011 Nishiwaki et al.
8,112,909 B2 2/2012 Kubo et al.
8,171,655 B2 * 5/2012 Morgan ..... A43B 7/144 36/103
8,418,379 B2 4/2013 Nishiwaki et al.
8,453,344 B2 6/2013 Nishiwaki et al.
8,461,222 B2 6/2013 Mori et al.
8,544,190 B2 10/2013 Nishiwaki et al.
8,819,965 B2 * 9/2014 Baker ..... A43B 3/0042 36/126
8,931,187 B2 * 1/2015 Healy ..... A43B 13/122 36/103
D734,927 S 7/2015 Ando et al.
D734,928 S 7/2015 Ando et al.
9,089,185 B2 7/2015 Nishiwaki et al.
2003/0177666 A1 9/2003 Nakano et al.
2003/0192199 A1 * 10/2003 Nakano ..... A43B 5/00 36/25 R
2007/0277401 A1 * 12/2007 Young-Chul ..... A43B 13/12 36/30 R
2009/0013558 A1 * 1/2009 Hazenberg ..... A43B 1/0009 36/88
2011/0185590 A1 8/2011 Nishiwaki et al.
2011/0197468 A1 8/2011 Kubo et al.
2012/0036740 A1 * 2/2012 Gerber ..... A43B 5/02 36/134
2013/0047474 A1 2/2013 Healy et al.
2013/0333251 A1 12/2013 Taniguchi et al.
2015/0013187 A1 1/2015 Taniguchi et al.
2015/0082668 A1 3/2015 Nonogawa et al.
2015/0096200 A1 * 4/2015 Healy ..... A43B 13/122 36/103
2015/0135558 A1 5/2015 Inomata et al.
2015/0143723 A1 5/2015 Tateishi et al.
2015/0181975 A1 7/2015 Otsuka et al.
2015/0216258 A1 8/2015 Ueda et al.
2015/0250260 A1 9/2015 Bessho et al.
2016/0015122 A1 1/2016 Nishiwaki et al.
2016/0058120 A1 * 3/2016 Gerber ..... A43B 5/02 36/28

FOREIGN PATENT DOCUMENTS

JP H0438701 4/1992
JP H0565201 8/1993
JP H07265103 A 10/1995
JP H11137305 A 5/1999
JP 2005/185303 A 7/2005
JP 3120866 4/2006
JP 2007/312856 A 12/2007
WO WO-2010/038266 A1 4/2010

OTHER PUBLICATIONS

International Search Report Issued in PCT/JP2013/077631 dated Nov. 5, 2013.

* cited by examiner

SHOE SOLE

CROSS-REFERENCE TO RELATED APPLICATION

The present application claims priority to and is a national stage application, filed under 35 U.S.C. §371, of International Application No. PCT/JP2013/077631, filed on Oct. 10, 2013, the contents of which fully incorporated herein by reference in its entirety.

TECHNICAL FIELD

The present invention relates to an improvement to the layered structure of a midsole and an outsole.

BACKGROUND ART

A shoe sole is generally required to be light-weight, durable, gripping, shock-absorbing, bendable, etc., and each of these properties needs to be on a certain level or better while some of them are in a tradeoff relationship. In recent years, there has been a demand for better designing the tread surface of a shoe sole and for taking environmental considerations with a shoe sole.

For example, with a trail running shoe, or the like, one solution to increasing the gripping force of cleats is to increase the height of the cleats of the outsole. However, increasing the height of the cleats directly leads to an increase in the thickness of the cleats, which increases the weight. Moreover, with high cleats, upthrust is likely to be felt from cleat areas.

CITATION LIST

Patent Literature

First Patent Document: JP07-265103A (front page)
Second Patent Document: JP05-65201Y (front page)
Third Patent Document: JP04-38701Y (front page)
Fourth Patent Document: JP2005-185303A (front page)

SUMMARY OF INVENTION

JP07-265103A discloses a shoe sole in which the interface between the midsole and the outsole is in a wave-like configuration as seen in a lateral cross section. With this prior art, however, a rubber-made outsole is formed with a uniform thickness. Therefore, there will likely be durability problems due to the outsole wearing out.

JP05-65201Y discloses an injection-molded boot having cleats of a synthetic resin, which forms the body of the boot, protruding from the bottom surface of the shoe sole. Such a structure may not be suitable for a shoe sole including a midsole of a foam body and an outsole of a rubber.

JP04-38701Y discloses a multilayer shoe sole in which a long groove extending in the width direction is formed in the forefoot portion of the lower shoe sole. With this shoe sole, it will be possible to realize a good bendability in the forefoot portion.

JP2005-185303A discloses a stud that is thick in the bottom portion and thin in the upper portion. However, the stud of this prior art is not a rubber but is a resin spike material and has a lower hardness (D hardness) than that of the base. Therefore, the thick setting will not improve, but will rather lower, the grip of the stud.

That is, the high-hardness base shown in FIG. 6 of the prior art is thin in its lower portion and thick in its upper portion. Therefore, the flexibility and the grip will be higher when the stud is solid (intact).

An object of the present invention is to provide a shoe sole that can be expected to suppress the durability lowering and to be light-weight, gripping and shock-absorbing, as well as being adequately bendable. Moreover, one can also expect that it accommodates a greater design variety while taking environmental considerations.

A shoe sole of the present invention includes:

an outsole 1 made of a rubber having a tread surface 10 and an upper surface 11; and a mid sole 2 having an upper surface 21 and a lower surface 20, wherein the lower surface 20 is attached to the upper surface 11 of the outsole 1, and a main (primary) component of the mid sole 2 is a foam body (foamed material) having a thermoplastic resin component, wherein:

the outsole 1 includes:

a base 1B;

a plurality of first cleats 1C protruding in a downward direction Z from the base 1B to form the tread surface 10, wherein the plurality of first cleats 1C are arranged not only in a longitudinal direction, but also in a transverse direction; and a concave (depressed) surface 1F recessed (concaved) in the downward direction Z on the upper surface 11 of each of the first cleats 1C;

the lower surface 20 of the mid sole 2 includes a convex (protruding) surface 2F formed by a surface of a convex (protruding) portion 2P protruding (projecting out) in the downward direction Z from a base 2B of the mid sole 2;

the concave surface 1F and the convex surface 2F are in contact with, and attached to, each other; and a distance 1D from the tread surface 10 to a top 2T of the convex surface 2F in each of the first cleats 1C is greater than a thickness of the base 1B.

According to the present invention, the concave surface 1F is formed on the upper surface 11 of the first cleats 1C of the outsole 1, thereby reducing the weight of the outsole 1, of which the specific gravity is much larger than that of the midsole 2.

The concave surface 1F is formed on the upper surface of the first cleats 1C, with the convex portion 2P of the flexible midsole 2 fitted in the concave surface 1F. Therefore, the first cleats 1C will easily deform as compared with a case where the first cleats 1C are solid (intact). Thus, one can expect an improvement to the gripping property and the shock-absorbing property of the first cleats 1C.

On the other hand, since the distance 1D from the tread surface 10 of the first cleats 1C to the convex surface 2F of the midsole 2, i.e., the thickness of the tread (grounding) portion of the first cleats 1C, is generally greater than the thickness of the base 1B. Therefore, the durability of the sole will unlikely deteriorate due to the first cleats 1C wearing out.

Herein, the outsole 1 made of a rubber is formed by a foamed rubber material (a rubber foam) having a relatively small expansion ratio or a non-foamed rubber material (a non-foam body of rubber), and the outsole 1 has a greater specific gravity than the midsole 2 but is superior in wear resistance.

The foam body of the midsole 2 includes a thermoplastic resin component and any other suitable component. Examples of the thermoplastic resin component may include a thermoplastic elastomer and a thermoplastic resin.

Example types of the thermoplastic elastomer may include a styrene-based elastomer such as styrene-ethylene-butylene-styrene block copolymer (SEBS), and an ethylene-vinyl acetate copolymer (-based) elastomer.

Example types of the thermoplastic resin may include a vinyl acetate-based resin such as ethylene-vinyl acetate copolymer (EVA), polystyrene, and a styrene-butadiene resin. The resin components listed above may be used alone or in combination of two or more.

As used in the present invention, "a main (primary) component being a foam body" means that a half or more of the upper surface 21 or the lower surface 20 of the midsole 2, or a half or more of the volume of the midsole 2, is formed by a foam body and that the midsole 2 may partially include gel, pod-like members (pods), or the like.

Note that the thickness of a member should be measured in the direction normal to the surface of the member.

As used in the present invention, the Japanese word "top" means "top" in English, and it means the lower end of the convex surface 2F.

Moreover, "the distance 1D from the tread surface 10 to the top 2T being greater than the thickness of the base 1B" means that a cleat 1C may include a portion where the thickness is smaller than the thickness of the base 1B, and it is deemed (interpreted) that the relationship: distance 1D> base 1B is satisfied if at least any one or more of the requirements (1) to (8) below is satisfied or if any two or more of them are satisfied.

(1) For the relationship between each base 1B around each first cleat 1C and the first cleat 1C, the distance 1D is greater than the thickness of the base 1B.

(2) For the relationship between each base 1B around each first cleat 1C and the first cleat 1C, the distance 1D is greater than the average value of the thickness of the base 1B.

(3) For the relationship between each base 1B around each first cleat 1C and the first cleat 1C, where a recess such as a groove is formed in the base 1B around the cleat 1C, the distance 1D is greater than the maximum value of the thickness of the base 1B.

(4) For the relationship between each base 1B around each first cleat 1C and the first cleat 1C, the distance 1D is greater than the minimum value of the thickness of the base 1B.

(5) For the relationship between the plate-like (plate-shaped) or flat-plate-like (flat-plate-shaped) base 1B between adjacent first cleats 1C and the adjacent first cleats 1C, each distance 1D is greater than the thickness of the plate-like base 1B.

(6) For the relationship between the plate-like or flat-plate-like base 1B between adjacent first cleats 1C and the adjacent first cleats 1C, the average value of the distances 1D is greater than the average value of the thickness of the base 1B.

(7) For the relationship between the plate-like or flat-plate-like the base 1B between adjacent first cleats 1C and the adjacent first cleats 1C, where a recess such as a groove is formed in the base 1B around the cleat 1C, the minimum value of the distance 1D is greater than the maximum value of the thickness of the base 1B.

(8) For the relationship between the base 1B, which has a convex portion between adjacent first cleats 1C and the adjacent first cleats 1C, any one or more of the maximum value, the minimum value and the average value of the distance 1D is greater than the maximum value or the average value of the thickness of the base 1B.

Note that "plate-like (plate-shaped)" or "flat-plate-like (flat-plate-shaped)" means that the base 1B has no cleats protruding therefrom. Moreover, "tread surface 10" refers to the surface to be in contact with the ground when the sole is placed on a flat ground surface. Therefore, if a cleat includes a depressed (concave) portion at the center thereof, such a depressed portion does not form the tread surface 10.

Figure 1:
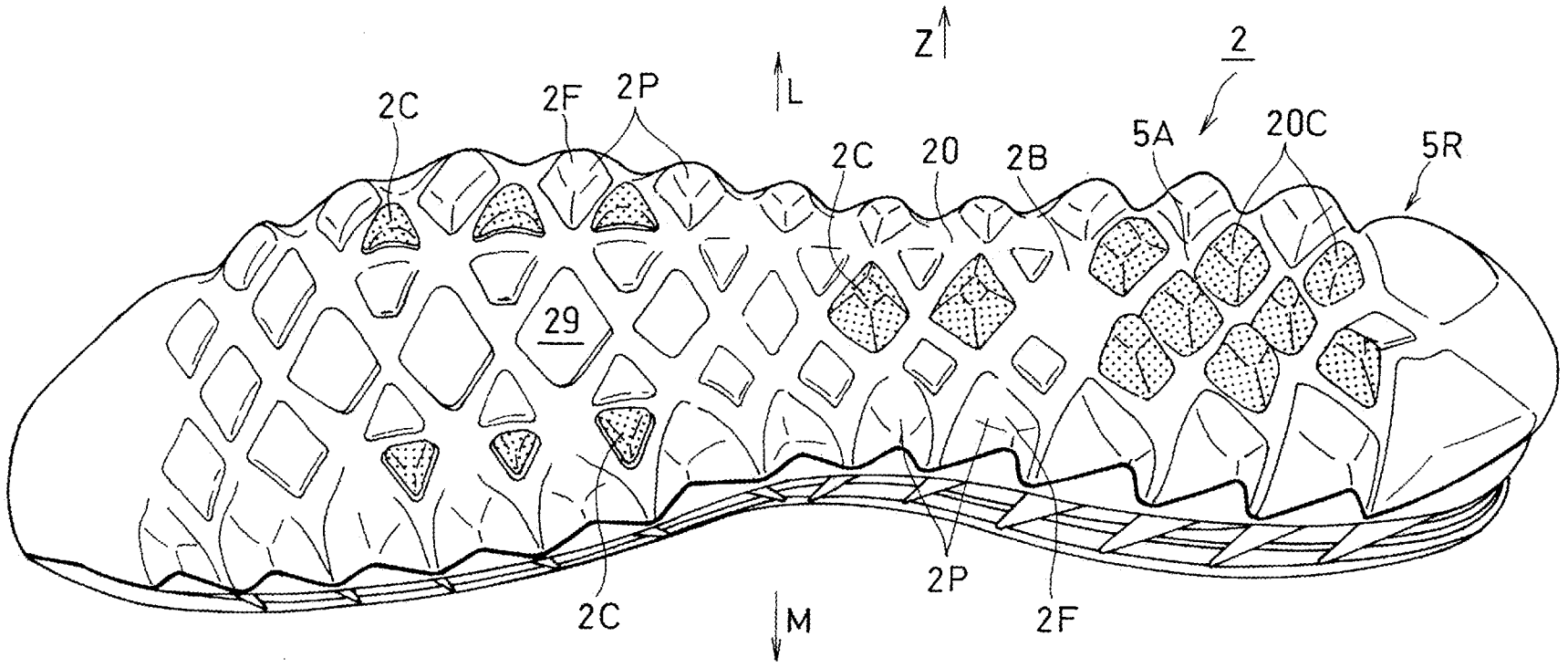
FIG. 1 is a perspective view showing a midsole according to one embodiment of the present invention.

Preferably, the mid sole 2 across the convex surface 2F is thicker than the base 2B around the convex portion 2P.

In such a case, the flexible midsole 2 is partially inside the first cleats 1C. Therefore, an upthrust is unlikely to be felt from the cleats 1C.

Preferably, the plurality of first cleats 1C each have a peripheral (outer circumferential) surface 1R extending between the tread surface 10 and the base 1B; and a thickness of the outsole 1 along the peripheral surface 1R decreases as the outsole extends in an upward direction, and increases as the outsole extends in the downward direction.

In such a case, the upper portion of a first cleat 1C is thinner than the lower portion of the first cleat 1C. Now, if an external force in the front-rear direction or in the medial-lateral direction is applied to the first cleat 1C, the first cleat 1C will likely undergo a shear deformation, which is approximate to a flexural deformation, about the upper end thereof joined with the midsole 2. Then, the largest moment occurs on the thin upper portion, and one can therefore expect that this will increase the deformation of the first cleat 1C.

On the other hand, the lower portion of the first cleats 1C is more likely to come into contact with a hard object or the ground surface, than is the upper portion thereof. However, the lower portion of the first cleat 1C, which is relatively thicker than the upper portion thereof, can suppress the deterioration of the durability of the first cleats 1C due to such contact.

Preferably, the first cleats 1C each have an upper edge portion 1E diagonally extending from the base 1B toward the tread surface 10 and being joined with a peripheral edge of the convex surface 2F; and a thickness of the upper edge portion 1E is less than a thickness of the base 1B.

In such a case, the aforementioned deformation will occur about the upper edge portion 1E, which is thinner than the thickness of the base 1B. Therefore, the largest moment occurs on the thin upper edge portion 1E, and one can expect that this will further increase the deformation of the first cleat 10.

Note that the aforementioned thickness relationship may be reversed for some of the many first cleats 1C provided on the outsole 1.

Preferably, the first cleats 1C are arranged on (along) a medial edge 1M and/or a lateral edge 1L of the shoe sole, with a side surface of the convex portion 2P being exposed on the medial edge 1M and/or the lateral edge 1L.

In such a case, the convex portion 2P of the midsole 2 is exposed on the medial edge 1M and/or the lateral edge 1L, and the medial edge 1M and/or the lateral edge 1L, where the convex portion 2P of the midsole 2 is exposed, will more easily undergo (show) such a deformation as described above, as compared with a shoe sole with no such exposure.

More preferably, a plurality of the first cleats 1C are arranged intermittently along a medial edge 1M or a lateral edge 1L of the shoe sole, with a side surface of the convex portion 2P being exposed on the medial edge 1M or the lateral edge 1L; and an interface between the upper surface 11 of the outsole 1 and the lower surface 20 of the midsole 2 appears (is displayed) as a wave-shaped (waveform) curve along the medial edge 1M or the lateral edge 1L.

In such a case, the first cleats 1C, which are arranged intermittently, can easily undergo such a deformation as described above, and one can easily expect the advantageous effect from the deformation.

Even more preferably, a plurality of the first cleats 1C are arranged intermittently along a medial edge 1M of the shoe sole, with a side surface of the convex portion 2P being exposed on the medial edge 1M;

an interface between the upper surface 11 of the outsole 1 and the lower surface 20 of the midsole 2 appears (is displayed) as a wave-shaped (waveform) curve along the medial edge 1M;

a plurality of the first cleats 1C are arranged intermittently along a lateral edge 1L of the shoe sole, with a side surface of the convex portion 2P being exposed on the lateral edge 1L;

an interface between the upper surface 11 of the outsole 1 and the lower surface 20 of the midsole 2 appears as a wave-shaped (waveform) curve along the lateral edge 1L;

the plurality of first cleats 1C each have a peripheral (outer circumferential) surface 1R extending between the tread surface 10 and the base 1B; and a thickness of the outsole 1 along the peripheral surface 1R decreases as the outsole extends in an upward direction, and increases as the outsole extends in the downward direction.

In such a case, the first cleats 1C, which easily deform, are arranged intermittently both on the medial edge 1M and on the lateral edge 1L, and one can better expect the advantageous effect from the aforementioned deformation.

Now, in running and trail running, the upper surface 21 of the midsole sinks in the downward direction generally along the longitudinal axis of the foot, thereby producing a guidance line while running, and one can expect an improvement to the stability while running. (e.g., US-2011-0185590-A1, WO101038266A1)

In the present embodiment, a plurality of cleats 1C are arranged intermittently both on the medial edge 1M and on the lateral edge 1L. Therefore, the medial edge 1M and the lateral edge 1L will deform (shift, or be displaced) above other positions along the longitudinal axis of the foot while running, and the upper surface 21 of the midsole 2 will sink along the longitudinal axis of the foot. This may improve the stability of running.

Preferably, the outsole 1 includes three or more of the first cleats 1C or a plurality of second cleats other than (separate from) the first cleats 1C, with a first through hole H1 being defined in an area surrounded by three or more of the first and/or second cleats; and the mid sole 2 includes a further (another) first cleat 2C made of the foam body protruding (projecting out) in the downward direction Z through the first through hole H1.

For example, in trail running, a runner runs on a hard ground surface covered with many pebbles or on a slope. When running on the hard ground surface, if all the cleats are hard, the cleats may not easily bite into the hard ground surface, and the many pebbles may not easily bite into between the cleats.

In a case of this example, the first cleats 2C, which are made of the foam body (foamed material) of the midsole 2, are much softer than the first cleats 1C of the outsole 1, and pebbles may easily bite into the midsole 2 on the hard ground surface.

On the other hand, the first through holes H1 formed in the outsole 1 are helpful in reducing the weight of the outsole 1.

Now, the midsole 2 and the outsole 1 are joined (integrated) together, by being bonded or welded together, thereby increasing the thickness, thus significantly increasing the rigidity against flexure, i.e., the flexural rigidity $EI_Z$. The flexural rigidity $EI_Z$ is in proportion to the Young's modulus of the material. Therefore, the first cleats 2C of the midsole 2 and the first through holes H1 formed in the outsole 1 contribute to the lowering of the flexural rigidity $EI_Z$, which will improve the bendability of the shoe sole.

Moreover, since the first through holes H1 are provided in the outsole 1, of which the specific gravity is much larger than that of the midsole 2, it is possible to reduce the weight and it is also more desirable for the environment.

The surface of the midsole 2 typically has a different color from the outsole 1 and/or a beautiful texture (appearance), and the cleats 2C of the midsole 2 and the outsole 1 forming a contrast in color therebetween will be helpful in increasing the design variety of the shoe sole.

Preferably, the base 1B of the outsole 1 has a plurality of through holes H2 defined in a central area 5A of a rear foot portion 5R; and the mid sole 2 includes a plurality of further (other) second cleats 20C made of the foam body and protruding (projecting out) in the downward direction Z through the second through holes H2.

In this case, the second through holes H2 and the cleats 20C will realize similar effects to the first through hole H1 and the cleats 10C.

Particularly, a plurality of second through holes H2 and cleats 20C are provided in the central area 5A of the rear foot portion 5R, which will give the rear foot portion 5R a gripping property, and give the heel of the rear foot portion 5R an adequate cushioning property.

Preferably, the outsole 1 includes three or more of the first cleats 1C or a plurality of second cleats other than (separate from) the first cleats 1C, with a first through hole H1 being defined in an area surrounded by three or more of the first and/or second cleats;

the midsole 2 includes a plurality of further (other) first cleats 2C made of the foam body and protruding (projecting out) in the downward direction Z through the first through hole H1;

the base 1B of the outsole 1 has a plurality of second through holes H2 defined in a central area 5A of a rear foot portion 5R;

the midsole 2 includes a plurality of further (other) second cleats 20C made of the foam body and protruding (projecting out) in the downward direction Z through the second through holes H2; and a total number of first and second cleats 2C and 20C of the midsole 2 is set to be 6 to 40.

In such a case, the advantage from the aforementioned deformation will further improve, and the advantageous effect from the cushioning will also be realized.

The 6 to 40 first and second cleats 2C and 20C of the midsole 2 will provide novel designs of a shoe sole.

In order to realize the designability and to prevent slippage in trail running, the number of first and second cleats 2C and 20C of the midsole 2 is preferably 8 to 35, and most preferably about 10 to 30.

Preferably, a Young's modulus of the outsole 1 is greater than a Young's modulus of the midsole 2.

The hardness of a foamed resin material (foam body of resin) or that of a rubber has a strong correlation with the Young's modulus.

The midsole 2 is typically more flexible than the outsole 1, and the hardness thereof is much smaller than that of the outsole 1. However, because their hardnesses are measured by using different methods, the concept of Young's modulus is employed instead of their hardness relationship.

Typically, the hardness of the midsole 2 is set to about 40° to 75° in terms of the asker C hardness. On the other hand, the hardness of the outsole 1 is set to about 55° to 70° in terms of the JIS-A hardness. Note that 70° in the JIS-A hardness corresponds to about 86° in the asker C hardness.

EMBODIMENTS

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

An embodiment of the present invention will now be described with reference to the drawings.

The present embodiment is a shoe sole of a shoe for trail running, for example.

Figure 2:
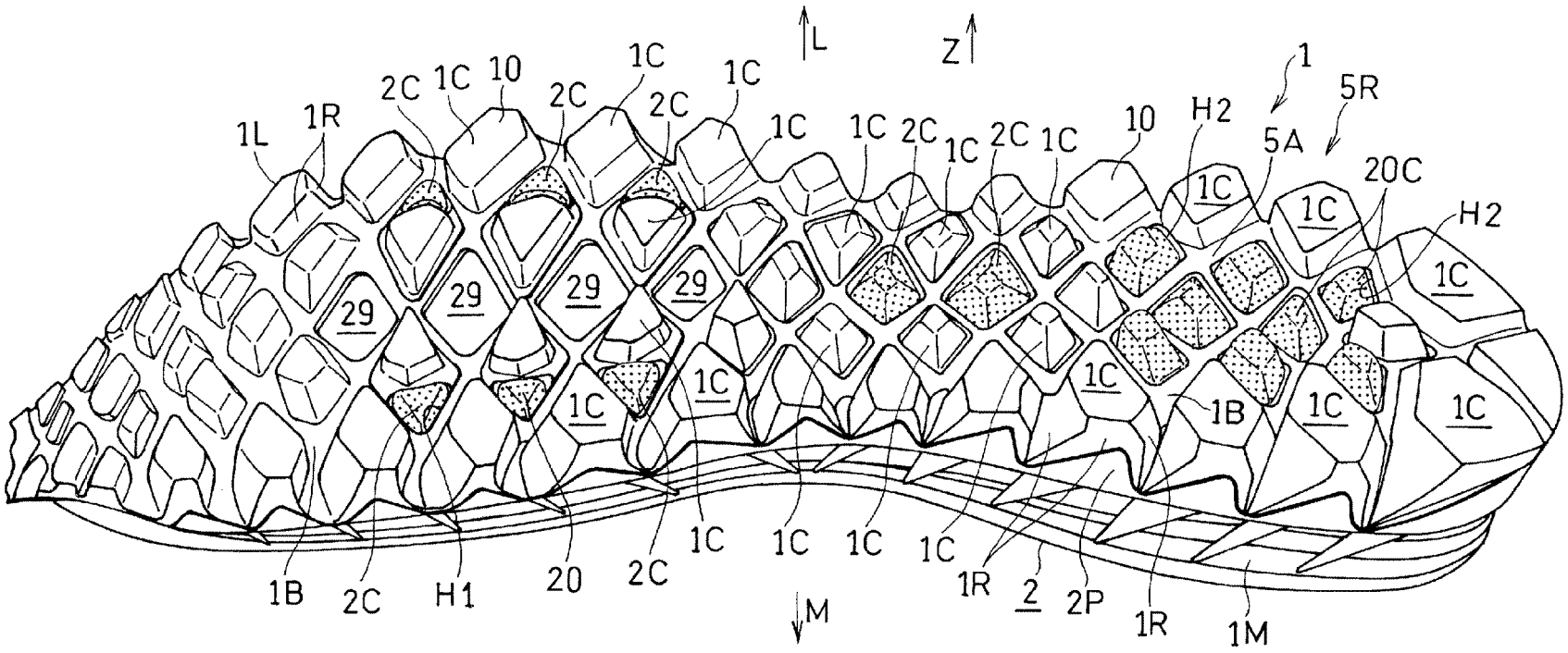
FIG. 2 is a perspective view showing the shoe sole.

As shown in FIG. 2, the shoe sole includes one outsole 1 made of a rubber, and one midsole 2 made of a resin. Note that an upper (not shown) wrapping around the instep is provided on the shoe sole.

A primary component of the midsole 2 is a foam body of EVA, for example, and the midsole 2 may include a reinforcement unit 29. The midsole 2 may be provided with a low-resilience material, a high-resilience material, a groove, etc.

The outsole 1 is a tread bottom having a greater wear resistance than the foam body of the midsole 2, and typically has a greater hardness and a greater Young's modulus than those of the foam body of the midsole 2. Note that "made of a rubber" herein means that it contains a component of a natural rubber or a synthetic rubber, and may contain any other suitable component.

Figures 5A, 5B, 5C, 5D, 5E:
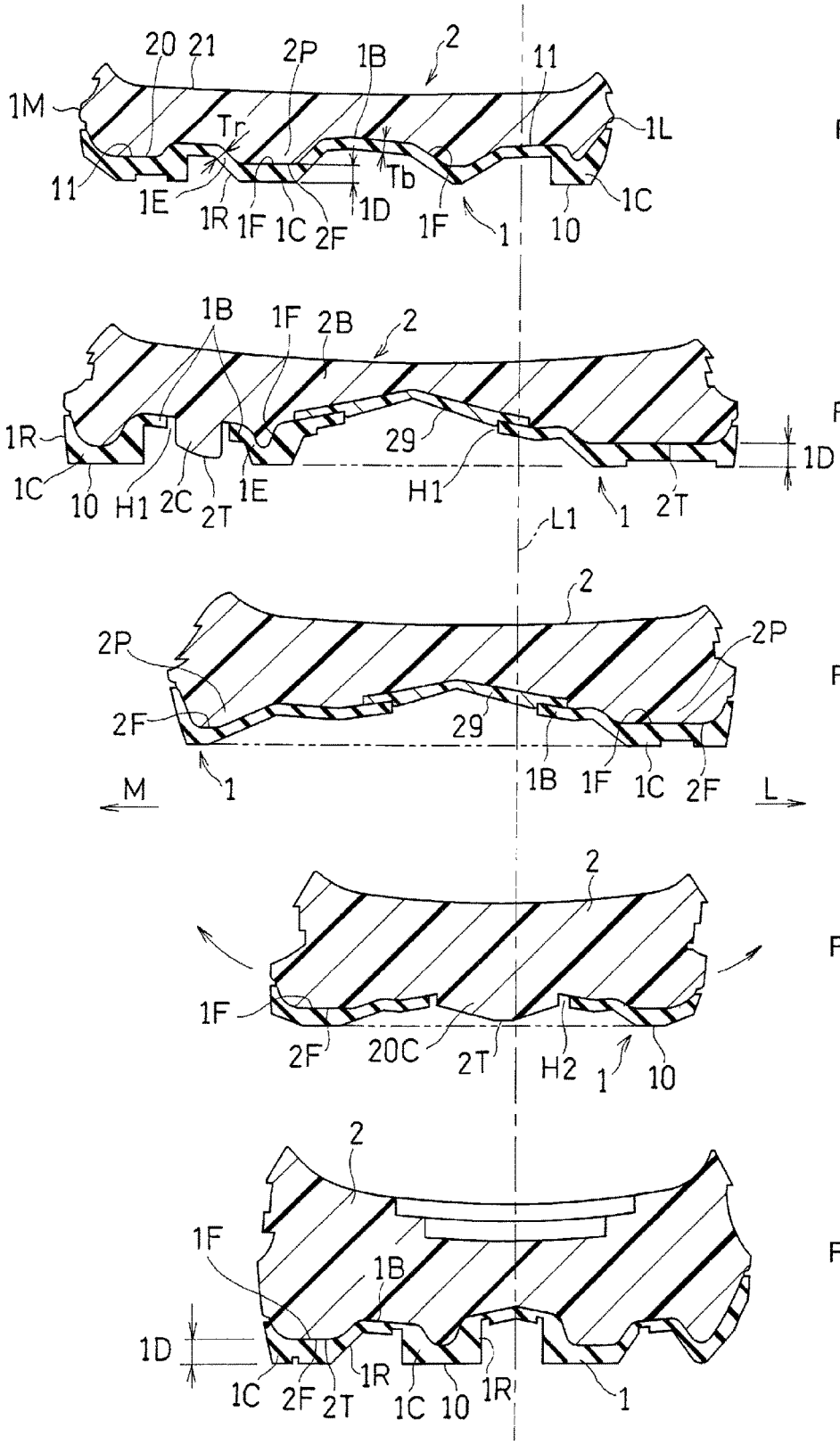
FIG. 5A, FIG. 5B, FIG. 5C, FIG. 5D and FIG. 5E are each a lateral cross-sectional view of the shoe sole.

As shown in FIG. 5A, the outsole 1 includes the tread surface 10 and the upper surface 11. The midsole 2 includes the upper surface 21 and the lower surface 20, and the lower surface 20 is attached to the upper surface 11 of the outsole 1.

The midsole 2 of FIG. 1 generally covers the entire surface of the foot sole. On the other hand, the outsole 1 of FIG. 2 includes a base portion 1B, and many first cleats 1C and many first and second through holes H1 and H2 formed on the base portion 1B. The lower surface 20 of the midsole 2 protrudes through some of the through holes H1 and H2, thereby forming many first and second cleats 2C and 20C.

Figure 3:
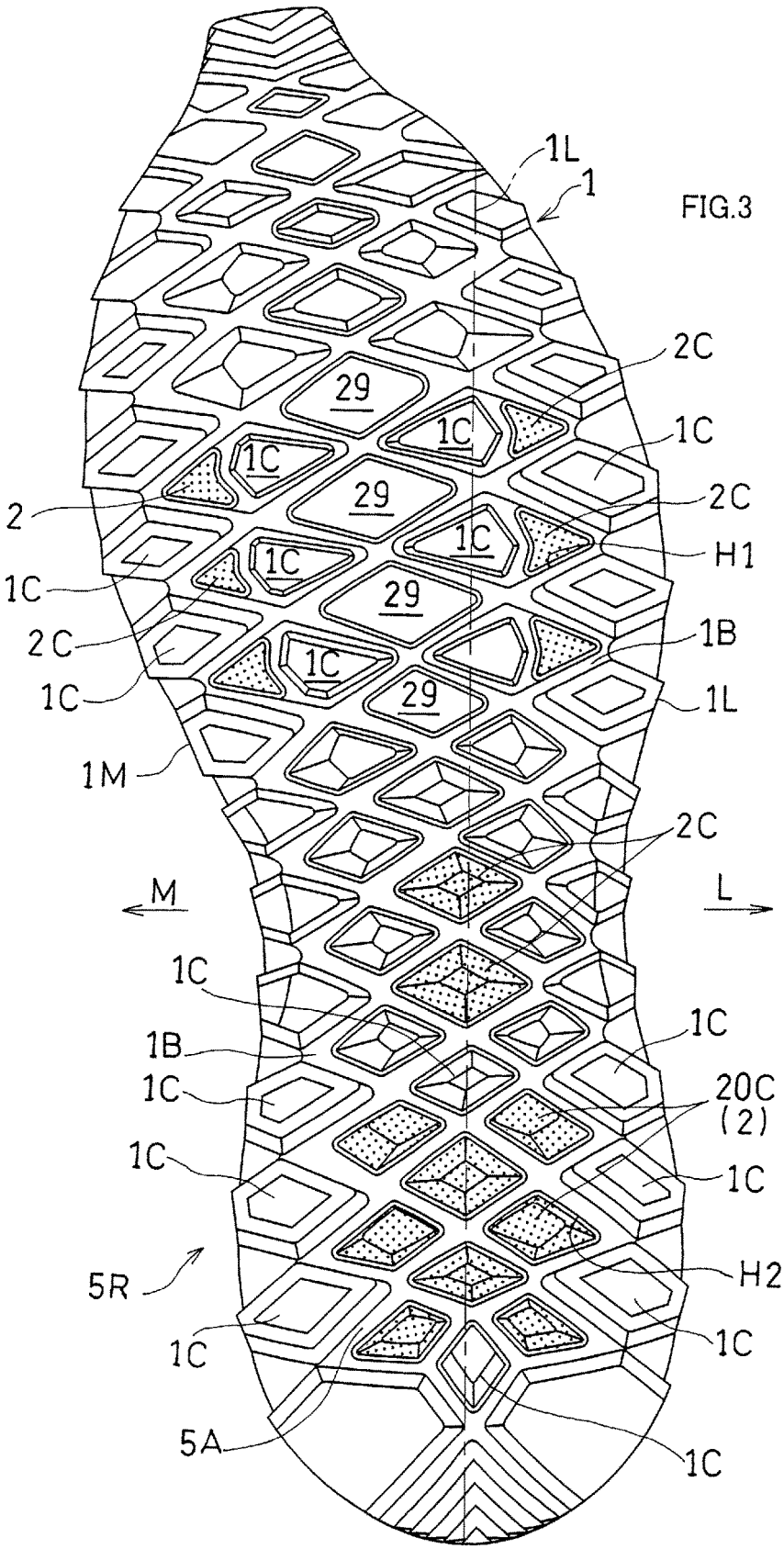
FIG. 3 is a bottom view showing the shoe sole.

Note that the first and second cleats 2C and 20C of the midsole 2 are shaded with dots in FIG. 1 to FIG. 3.

The outsole 1 of FIG. 2 includes a plate-like base 1B and many first cleats 1C. The plurality of first cleats 1C protrude downward in the downward direction Z from the base 1B to form the tread surface 10, wherein the plurality of first cleats 1C are arranged in the longitudinal direction and in the transverse direction. As shown in FIG. 5A, the upper surface 11 of each of the first cleats 1C (most of the cleats) includes the concave surface 1F recessed in the downward direction Z.

The lower surface 20 of the midsole 2 of FIG. 1 includes the convex surface 2F formed by the surface of the convex portion 2P protruding in the downward direction Z from the base 2B of the midsole 2. As shown in FIGS. 5A to 5E, the concave surface 1F and the convex surface 2F are in contact with each other and are attached (joined by being bonded or welded) together. As clearly shown in FIG. 5A and FIG. 5E, the distance 1D from the tread surface 10 to the top 2T of the convex surface 2F in each of the first cleats 1C is greater than the thickness Tb of the base 1B. For example, the distance 1D shown in FIG. 5A is greater than the average value and the maximum value of the thickness Tb of the base 1B therearound. As clearly shown in FIG. 5A to FIG. 5E, the first cleats 1C and the base 1B of the present embodiment satisfy one or more of the requirements (1) to (8) defined above.

As clearly shown in FIG. 5A, the midsole 2 at the convex surface 2F is thicker than the base 2B around the convex portion 2P. The lower surface 20 of the generally flat base 2B of the midsole 2 is joined, by being bonded or welded, with the upper surface 11 of the generally flat base 1B of the outsole 1.

Note that the line L1 in FIG. 3 and FIG. 5A to FIG. 5E denotes a reference line.

The plurality of first cleats 1C of FIG. 5B each have the peripheral surface 1R extending between the tread surface 10 and the base 1B. For the first cleat 10 on the medial side M in FIG. 5B and FIG. 5E and the central first cleat 1C in FIG. 5E, the thickness of the outsole 1 along the peripheral surface 1R decreases in the upward direction and increases in the downward direction.

For some of the first cleats 1C, e.g., the first cleat 10 of FIG. 5A, the peripheral surface 1R has the upper edge portion 1E diagonally extending downward from the base 1B toward the tread surface 10 and being joined with a peripheral edge of the convex surface 2F, and the thickness Tr of the upper edge portion 1E is slightly smaller than the thickness Tb of the base 1B.

Figure 4A:
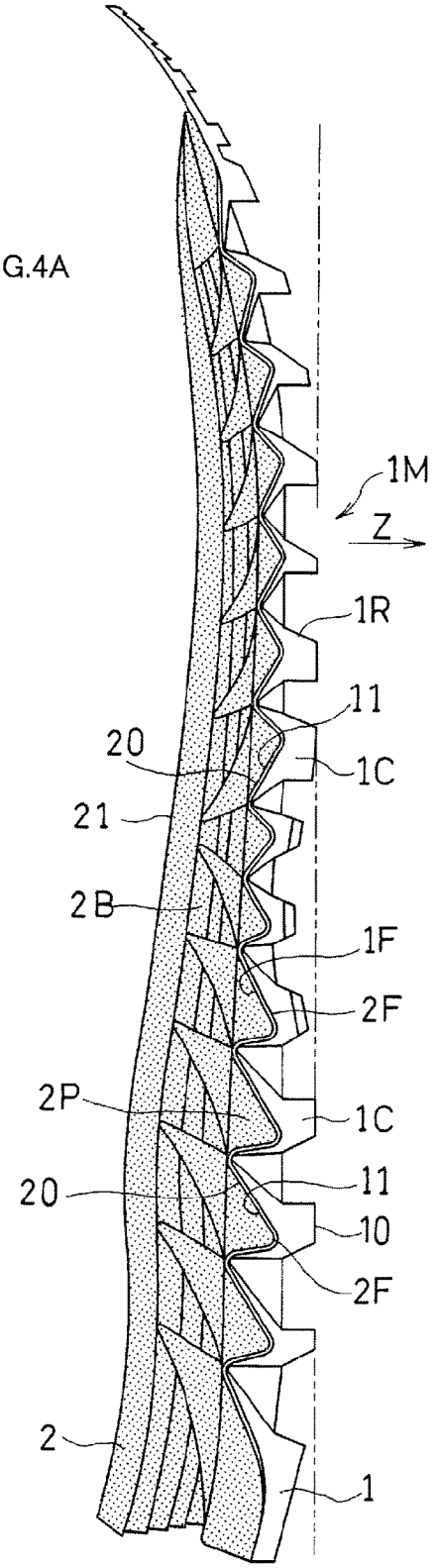
FIG. 4A is a medial side view showing the shoe sole.
Figure 4B:
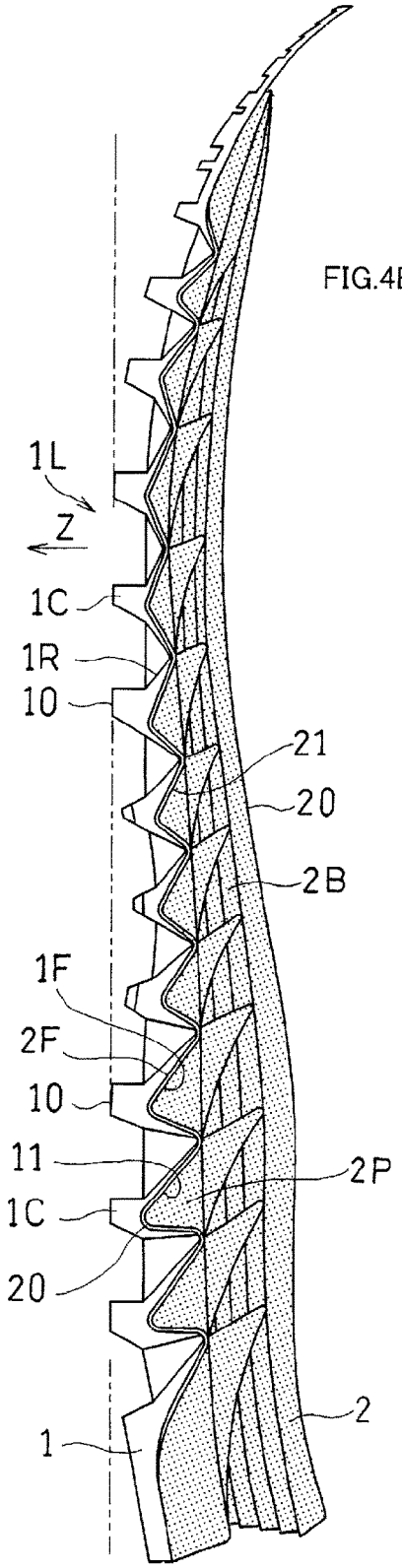
FIG. 4B is a lateral side view showing the shoe sole.

As shown in FIG. 4A and FIG. 4B, many (not all) of the first cleats 1C are arranged intermittently along the medial edge 1M and the lateral edge 1L of the shoe sole, with the side surface of the convex portion 2P being exposed on the medial edge 1M and the lateral edge 1L. Note that in FIG. 4A and FIG. 4B, the side surface of the midsole 2 is shaded with dots.

In FIG. 4A, many of the first cleats 1C are arranged intermittently along the medial edge 1M of the shoe sole, with the side surface of the convex portion 2P being exposed on the medial edge 1M. Therefore, the interface between the upper surface 11 of the outsole 1 and the lower surface 20 of the midsole 2 appears, along most (more than half) of the length of the medial edge 1M, as a wave-like continuous curve on the medial edge 1M with the convex surface 2F being partially exposed.

In FIG. 4B, many other ones of the first cleats 1C are arranged intermittently along the lateral edge 1L of the shoe sole, with the side surface of the convex portion 2P being exposed on the lateral edge 1L. Therefore, the interface between the upper surface 11 of the outsole 1 and the lower surface 20 of the midsole 2 appears, along most (more than half) of the length of the lateral edge 1L, as a wave-like continuous curve on the lateral edge 1L with the convex surface 2F being partially exposed.

By being formed in a wave-like configuration, as described above, the medial and lateral edges 1M and 1L are flexible, and is easily bendable as indicated by an arrow in FIG. 5D so that the central portion on the medial side and on the lateral side of the midsole 2 can easily sink in the downward direction.

As shown in FIG. 1, the plurality of first cleats 1C along the side edges 1M and 1L each have the peripheral surface 1R extending between the tread surface 10 and the base 1B, and the thickness of the outsole 1 along the peripheral surface 1R decreases in the upward direction and increases in the downward direction as shown in FIG. 5B, FIG. 5C and FIG. 5E.

In FIG. 2, each first through hole H1 is formed in a portion of the base portion 1B surrounded by three or four of the first cleats 1C of the outsole 1. Each first cleat 2C of the midsole 2 protrudes in the downward direction Z through the first through hole H1.

Note that the outsole 1 may include normal, second cleats, different from the cleats 1C, e.g., cleats with no concave surface 1F, and the first through holes H1 and the first cleats 2C of the midsole 2 may be provided each in an area of the base 1B surrounded by three or four of the second cleats or the first cleats 1C.

As shown in FIG. 5D and FIG. 2, in the central area 5A of the rear foot portion 5R, the base 1B of the outsole 1 is formed in a lattice pattern with a few (three) or more through holes H2 formed therein. These second through holes H2 are provided adjacent to each other in the central area 5A of the rear foot portion 5R of the base 1B of the outsole 1. Each second cleat 20C of the midsole 2 protrudes in the downward direction Z through a corresponding one of the second through holes H2. The hard first cleats 1C of the outsole 1 are arranged around (i.e., on the front side, the rear side, the medial side M and the lateral side of) the group of second cleats 20C. These first cleats 1C are useful in protecting the group of second cleats 20C.

Note that the central area 5A of the rear foot portion 5R means an area of the rear foot portion 5R excluding the front and rear ends and the medial and lateral edges 1M and 1L of the rear foot portion 5R.

The total number of first and second cleats 2C and 20C of the midsole 2 is set to be 10 to 20, for example.

Where the shoe sole of FIG. 4A and FIG. 4B is under no load, the top 2T of the first and second cleats 2C and 20C made of the foam body shown in FIG. 1 and FIG. 5D is spaced further away from the ground surface than the tread surface 10 of the first cleats 1C of the outsole 1. Therefore, it will unlikely come into contact with the ground on a flat ground surface, while it will likely come into contact with the ground on a hard ground surface with many pebbles thereon.

As cleats different from the cleats 1C of the outsole 1, for example, a small through hole may be provided running through a cleat 10 with the convex surface 2F of the midsole 2 being exposed through the through hole.

Alternatively, the cleats 2C and the cleats 20C may not be protruding through the first through holes H1 and the second through holes H2 of the midsole 2 of FIG. 2, and the flat lower surface 20 of the base 2B of the midsole 2 may instead be exposed through the first through holes H1, etc.

While preferred embodiments have been described above with reference to the drawings, various obvious changes and modifications will readily occur to those skilled in the art upon reading the present specification.

For example, the reinforcement unit 29 may be absent (not be provided). Grooves may be provided around cleats of the outsole. The midsole and/or the outsole may each be formed by a plurality of layers of member.

Thus, such changes and modifications are deemed to fall within the scope of the present invention, which is defined by the appended claims.

INDUSTRIAL APPLICABILITY

The present invention is applicable to the shoe sole of walking shoes, rain shoes and shoes of daily use, as well as to the shoe sole of athletic shoes, such as trail running shoes, mountain climbing shoes and cross country shoes.

REFERENCE SIGNS LIST

1: Outsole, 1B: Base, 1C: First cleat, 1D: Distance, 1E: Upper edge portion, 1F: Concave surface, 1M: Medial edge, 1L: Lateral edge, 1R: Peripheral surface, 10: Tread surface, 11: Upper surface

2: Midsole, 2B: Base, 2C: First cleat, 20C: Second cleat, 2F: Convex surface, 2P: Convex portion, 2T: Top, 20: Lower surface, 21: Upper surface, 29: Reinforcement unit

5R: Rear foot portion, 5A: Central area

H1: First through hole, H2: Second through hole

L: Lateral side, L1: Reference line, M: Medial side

Z: Downward direction

The invention claimed is:

1. A shoe sole comprising:

an outsole made of a rubber having a tread surface and an upper surface; and a mid sole having an upper surface and a lower surface, wherein the lower surface of the mid sole is attached to the upper surface of the outsole, and wherein the mid sole comprises a foam body which includes a thermoplastic resin component, wherein:

the outsole includes:

a base;

a plurality of first cleats protruding in a downward direction from the base to form the tread surface, wherein the plurality of first cleats is arranged in a longitudinal direction and in a transverse direction; and a concave surface recessed in the downward direction on the upper surface of each of the first cleats;

the lower surface of the mid sole includes a convex surface formed by a surface of a convex portion protruding in the downward direction from a base of the mid sole;

the concave surface and the convex surface are in contact with, and attached to, each other;

a distance from the tread surface to a top of the convex surface in each of the first cleats is greater than a thickness of the base of the outsole;

a single through hole is defined in a part of the outsole, said part surrounded by at least three first cleats of the first cleats of the outsole;

the mid sole has another first cleat protruding in the downward direction through the single through hole in the part of the outsole;

the another first cleat of the mid sole has a single uniform ground contacting surface; and the another first cleat of the mid sole is adjacent to and surrounded by the at least three first cleats of the outsole.

2. The shoe sole according to claim 1, wherein:

the mid sole across the convex surface is thicker than a base of the mid sole around the convex portion.

3. The shoe sole according to claim 1, wherein:

the plurality of first cleats each has a peripheral surface extending between the tread surface and the base of the outsole; and a thickness of the outsole along the peripheral surface decreases in an upward direction and increases in the downward direction.

4. The shoe sole according to claim 1, wherein:

each of the plurality of first cleats has an upper edge portion diagonally extending from the base of the outsole toward the tread surface, the upper edge portion being joined with a peripheral edge of the convex surface; and a thickness of the upper edge portion is less than a thickness of the base of the outsole.

5. The shoe sole according to claim 1, wherein:

the first cleats are arranged on a medial edge and/or a lateral edge of the shoe sole, with a side surface of the convex portion being exposed on the medial edge and/or the lateral edge.

6. The shoe sole according claim 1, wherein:

a plurality of the first cleats are arranged intermittently along a medial edge or a lateral edge of the shoe sole, with a side surface of the convex portion being exposed on the medial edge or the lateral edge; and an interface between the upper surface of the outsole and the lower surface of the midsole appears as a wave-shaped curve along the medial edge or the lateral edge.

7. The shoe sole according to claim 1, wherein:

a plurality of the first cleats are arranged intermittently along a medial edge of the shoe sole, with a side surface of the convex portion being exposed on the medial edge;

an interface between the upper surface of the outsole and the lower surface of the midsole appears as a wave-shaped curve along the medial edge;

a plurality of the first cleats are arranged intermittently along a lateral edge of the shoe sole, with a side surface of the convex portion being exposed on the lateral edge;

the interface between the upper surface of the outsole and the lower surface of the midsole appears as a wave-shaped curve along the lateral edge;

the plurality of first cleats each have a peripheral surface extending between the tread surface and the base of the outsole; and a thickness of the outsole along the peripheral surface decreases in an upward direction and increases in the downward direction.

8. The shoe sole according to claim 1, wherein:

the outsole includes three or more of the first cleats or a plurality of second cleats other than the first cleats, with a first through hole being defined in an area surrounded by three or more of the first and/or second cleats; and the mid sole includes a further first cleat made of the foam body protruding in the downward direction through the first through hole.

9. The shoe sole according to claim 1, wherein:

the base of the outsole defines a plurality of second through holes in a central area of a rear foot portion; and the mid sole includes a plurality of further second cleats made of the foam body and protruding in the downward direction through the second through holes.

10. The shoe sole according to claim 1, wherein:

the outsole includes three or more of the first cleats or a plurality of second cleats other than the first cleats, with a first through hole being defined in an area surrounded by three or more of the first and/or second cleats;

the midsole includes a plurality of further first cleats made of the foam body and protruding in the downward direction through the first through hole;

the base of the outsole defines a plurality of second through holes in a central area of a rear foot portion;

the midsole includes a plurality of further second cleats made of the foam body and protruding in the downward direction through the second through holes; and a total number of first and second cleats of the midsole is set to be 6 to 40.

11. The shoe sole according to claim 9, wherein:

where the shoe sole is under no load, tops of the first and second cleats of the mid sole made of the foam body are spaced further away from the ground surface than the tread surface of the first and second cleats of the outsole.

12. The shoe sole according to claim 1, wherein:

a Young's modulus of the outsole is greater than a Young's modulus of the midsole.

13. A shoe sole comprising:

an outsole made of a rubber having a tread surface and an upper surface; and a mid sole having an upper surface and a lower surface, wherein the lower surface is attached to the upper surface of the outsole, and a main component of the mid sole is a foam body having a thermoplastic resin component, wherein:

the outsole including:

a base;

a plurality of first cleats protruding in a downward direction from the base to form the tread surface, wherein the plurality of first cleats are arranged in a longitudinal direction and in a transverse direction; and a concave surface recessed in the downward direction on the upper surface of each of the first cleats;

the lower surface of the mid sole includes a convex surface formed by a surface of a convex portion protruding in the downward direction from a base of the mid sole;

the concave surface and the convex surface are in contact with, and attached to, each other;

a distance from the tread surface to a top of the convex surface in each of the first cleats is greater than a thickness of the base of the outsole;

the first cleats are arranged intermittently along a medial edge or a lateral edge of the shoe sole, with a side surface of the convex portion being exposed on the medial edge or the lateral edge; and an interface between the upper surface of the outsole and the lower surface of the mid sole appears as a wave-shaped continuous curve along the medial edge or the lateral edge.

* * * * *